US006442766B1

(12) United States Patent
Arai

(10) Patent No.: US 6,442,766 B1
(45) Date of Patent: Sep. 3, 2002

(54) SHIELD SUPPORTING STRUCTURE IN HELMET

(76) Inventor: Michio Arai, c/o Arai Helmet, Ltd., 12, Azuma-cho 2-chome, Ohmiya-shi, Saitama-ken (JP)

( * ) Notice: Subject to any disclaimer, the term of this patent is extended or adjusted under 35 U.S.C. 154(b) by 0 days.

(21) Appl. No.: 09/729,182

(22) Filed: Dec. 5, 2000

(51) Int. Cl.[7] ..... A42B 1/24
(52) U.S. Cl. ..... 2/422; 2/424
(58) Field of Search ..... 2/422, 6.5, 6.7, 2/424

(56) References Cited

U.S. PATENT DOCUMENTS

| | | | | |
|---|---|---|---|---|
| 2,860,343 | A | * | 11/1958 | Aileo |
| 4,242,757 | A | * | 1/1981 | Nava |
| 4,247,960 | A | * | 2/1981 | Nava |
| 4,748,696 | A | * | 6/1988 | Fohl |

FOREIGN PATENT DOCUMENTS

| | | | |
|---|---|---|---|
| EP | 80202 A2 | * | 6/1983 |
| EP | 0498099 | | 8/1992 |
| FR | 2457080 | | 12/1980 |
| FR | 2541874 | | 9/1984 |
| GB | 2004178 | | 3/1979 |
| GB | 2087220 | * | 5/1982 |
| LU | 79815 | | 12/1978 |

* cited by examiner

*Primary Examiner*—Rodney M. Lindsey
(74) *Attorney, Agent, or Firm*—Dykema Gossett PLLC

(57) ABSTRACT

A helmet with shield and having a shield supporting structure that reduces wind-noise, the shield being substantially flush with an outer surface of the helmet shell when fully closed. The shield is ascended or descended against slant surface segments when the shield is moved in a forward or a rearward direction as the supporting shaft is moved in a forward or a rearward direction and the shield is turned in an upward or a downward direction so as to cause the shield to be protruded out of or indented into the step segment.

2 Claims, 11 Drawing Sheets

(PRIOR ART)

SHIELD SUPPORTING STRUCTURE IN HELMET

BACKGROUND OF THE INVENTION

1. Field of the Invention

This invention relates to a shield fixing structure that is installed at a full-face type helmet and an open face type helmet a driver wears when he or she rides on various kinds of motorized vehicles such as a motorcycle and an automobile, and more particularly, a shield fixing structure in which it may produce an outer appearance where the outer surface of the shield may become substantially flush with the outer surface of the shell when the shield is fully closed.

2. Description of the Related Art

As the shield-supporting structure in which the step segments for accepting at least the shield are formed at the shield installing positions of the shell in which it may produce an outer appearance where the outer surface of the shield may become substantially flush with the outer surface of the shell when the shield is fully closed, the structure has already been provided in the gazette of Japanese Utility Model Laid-Open No. Hei 2-22329, for example.

In this related art utility model described above, the shield is aligned with the step segment (the stage in the gazette) when the shield is fully closed to cause the outer surface of the shield (the outer side surface in the gazette) to be in flush with the outer surface of the shell (the outer side surface in the gazette).

When the shield is pushed out forwardly from this state, the front side of the shield is slid forwardly by the ratchet mechanisms installed at the right and left side surfaces of the shell and disengaged from the step segments and at the same time both right and left sides of the shield slide in the outer rightward and leftward directions and are disengaged from the step segments, resulting in that the shield can be pushed up and the shield can be fully opened.

In order to cause the shield to be fully closed again, the shield is pushed down and pushed back rearward to cause the shield to be aligned with the step segments and further the outer surface of the shield is in flush with the outer surface of the shell.

With such an arrangement as above, the related art aims to reduce wind-noise and to prevent rainwater from entering into the helmet.

As shown in FIG. 12, the ratchet mechanism in the related art is comprised of the ratchet base seat 100, the ratchet inner rotor 200, the shield holder 300, the ratchet outer rotor 400, the stopper washer 500, the bolt 600 and the ratchet cover 700, wherein each of these members is arranged to be overlapped to each other on the coaxial line at both sides of the shell 800.

As described above, since this ratchet mechanism has a substantial thickness due to the fact that many composing members are arranged to be overlapped to each other on the coaxial line at both sides of the shell 800, it is necessary that the shell is protruded inwardly by an amount corresponding to the thickness of the ratchet mechanism to make an indented notch part.

However, such an arrangement as above requires to make a thin thickness of the shock absorbing liner for absorbing shock applied to the head of the helmet wearer only in correspondence with the inward protrusion of the shell, so that it is not possible to provide a safety characteristic to the helmet wearing person.

As a method for assuring a thickness of the shock absorbing liner, it is satisfactory that the shock absorbing liner is formed in the beginning to have a thickness added with a thickness protruding inside the shell, although a size of the shell is increased in proportion to the thickness of the shock absorbing liner, resulting in that the helmet itself is made to be large in its size or its weight is increased.

That is, the utility model disclosed in the aforesaid gazette can reduce a wind-noise only after sacrifying to a certain degree a shock absorbing characteristic, an aerodynamic characteristic.

SUMMARY OF THE INVENTION

In view of the foregoing, it is an object of the present invention to provide a new shield-supporting structure in which wind-noise can be reduced.

DESCRIPTION OF THE PREFERRED EMBODIMENT

The technical means employed by the present invention in order to accomplish the aforesaid object involves a shield-supporting structure of a helmet in which a step segment 3 for accepting at least a shield 2 is formed at shield installing positions in a shell 1, the outer surface of the shield 2 being substantially flush with an outer surface of the shell 1 when the shield is fully closed. When the shield 2 is opened or closed, shield fixing segments 21L, 21R supported at supporting shafts 11L, 11R of right and left side surfaces of the shell 1 are turned around rotary centers CL, CR on each of base members 4L, 4R fixed to the shell 1, the center C1L of one supporting shaft (11L in the figure) being positioned more rearward than the rotary center CL when the shield 2 is fully closed. When the shield 2 is moved forward from this state and the center C1L of the supporting shaft 11L is moved forward to such a position as one where it becomes concentric with the rotary center CL, the shield 2 is disengaged from the step segment 3 at the front surface of the shell, and when the shield 2 is turned upwardly from this disengaged state, sections of the right and left shield fixing segments 21L, 21R forward of rotary centers CL, CR ride over the slant surface segments 5L, 5R arranged on the base members 4L, 4R. The shield fixing segments 21L, 21R become expanded outwardly and disengage from the step segment 3 at the side surface of the shell (first aspect).

A construction of the shield-supporting structure of the present invention will be described as follows, wherein as shown in FIGS. 1 to 4, the supporting shaft 11L rotatably supporting the shield 2 is pivotally supported at the base member 4L in such a way that the supporting shaft can be moved forward and rearward.

The other supporting shaft 11R is fixed to the base member 4R.

The step segment 3 has such a depth that the outer surface of the shell 1 and the outer surface of th shield 2 may become substantially flush with each other when the shield 2 is accepted.

Figure 1:
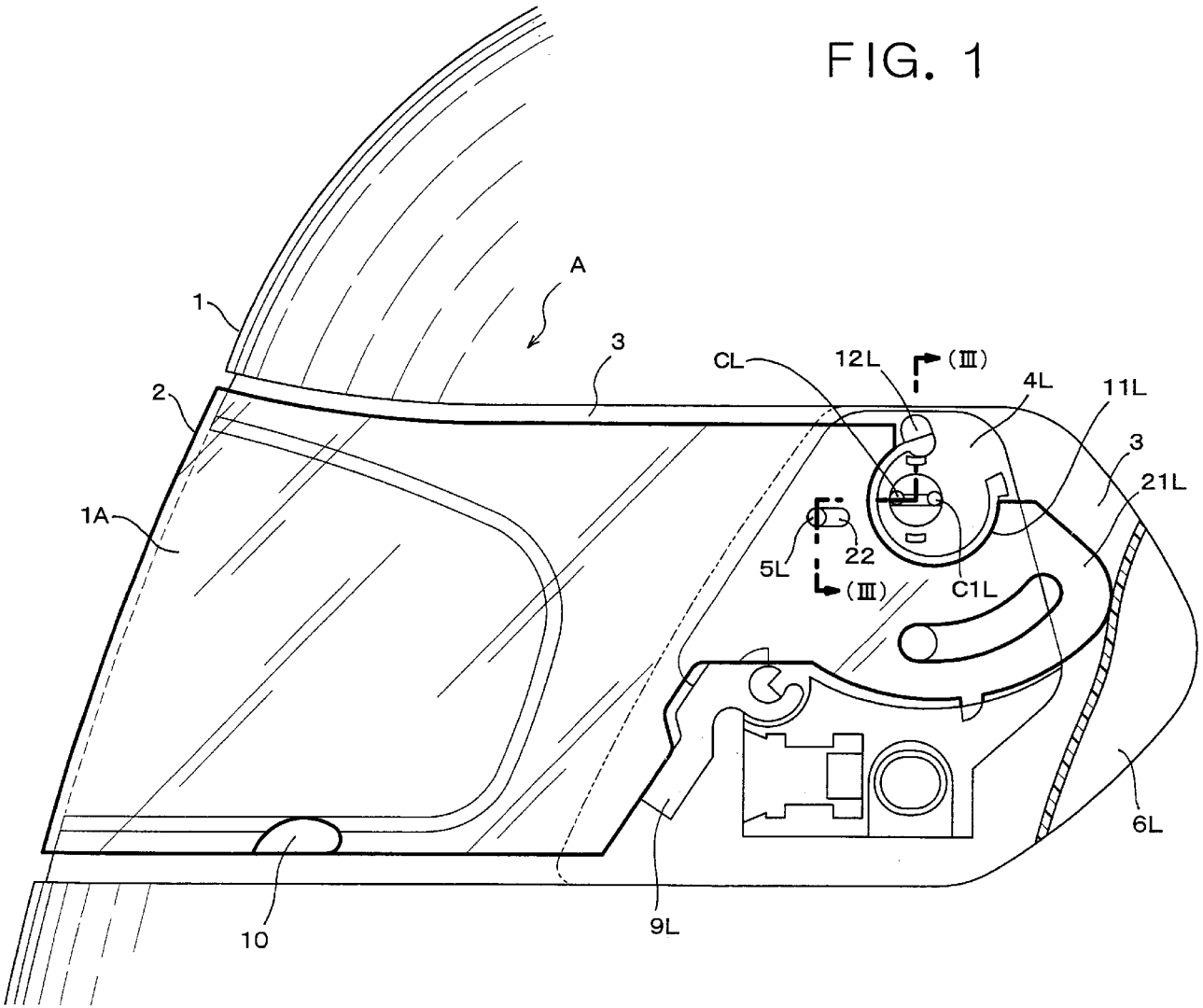
FIG. 1 is a left side elevational view of a helmet constructed according to the present invention.
Figure 6:
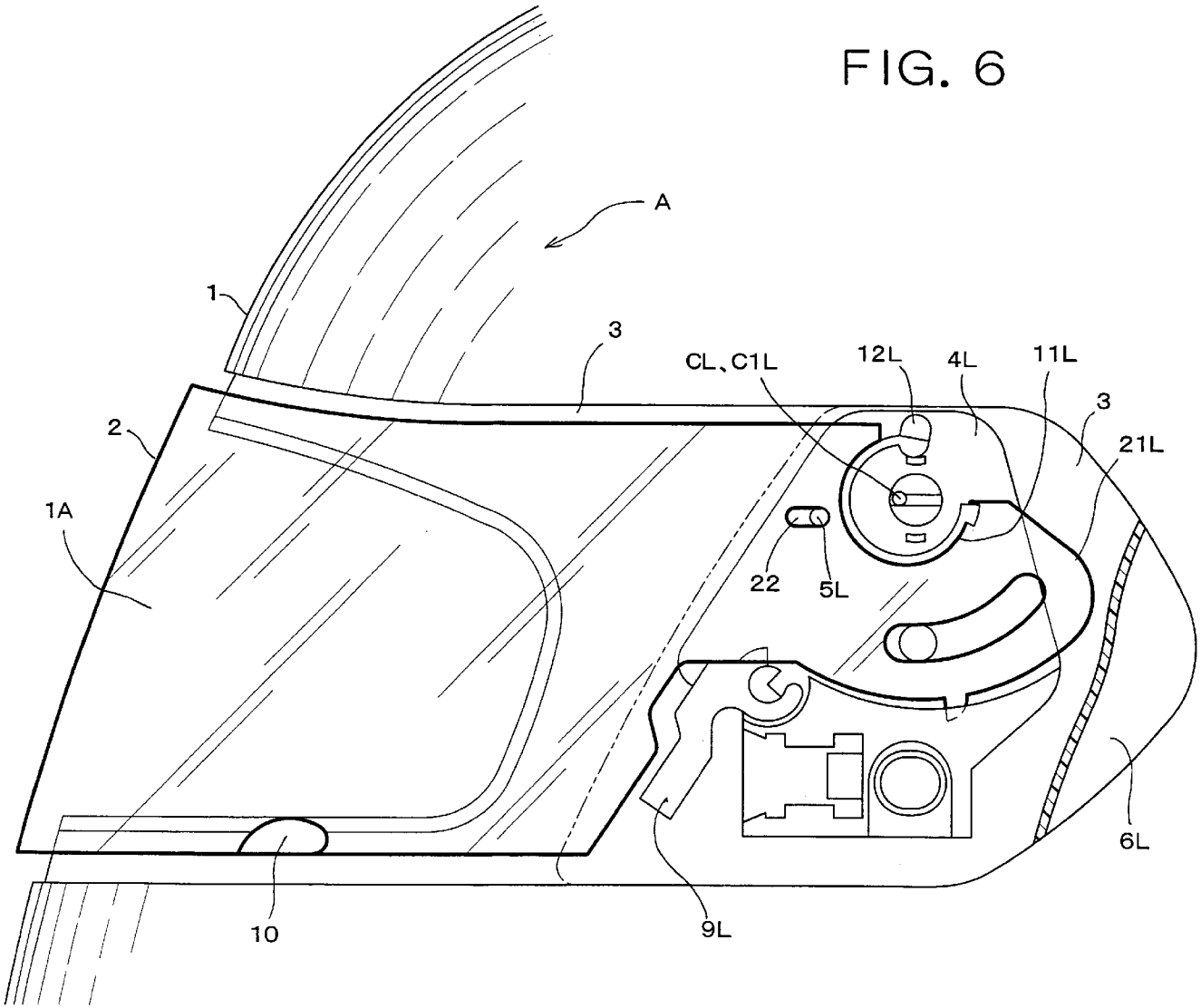
FIG. 6 is a left side elevational view for showing a state in which the shield is moved in a forward direction.

The rearward position of the supporting shaft 11L is a position where the shield 2 is accepted at the step segment 3 in its close contacted state as shown in FIG. 1, and the forward position of the supporting shaft is a position where the center C1L of the supporting shaft 11L and the rotary centers CL become concentric to each other as shown in FIG. 6.

Figure 7:
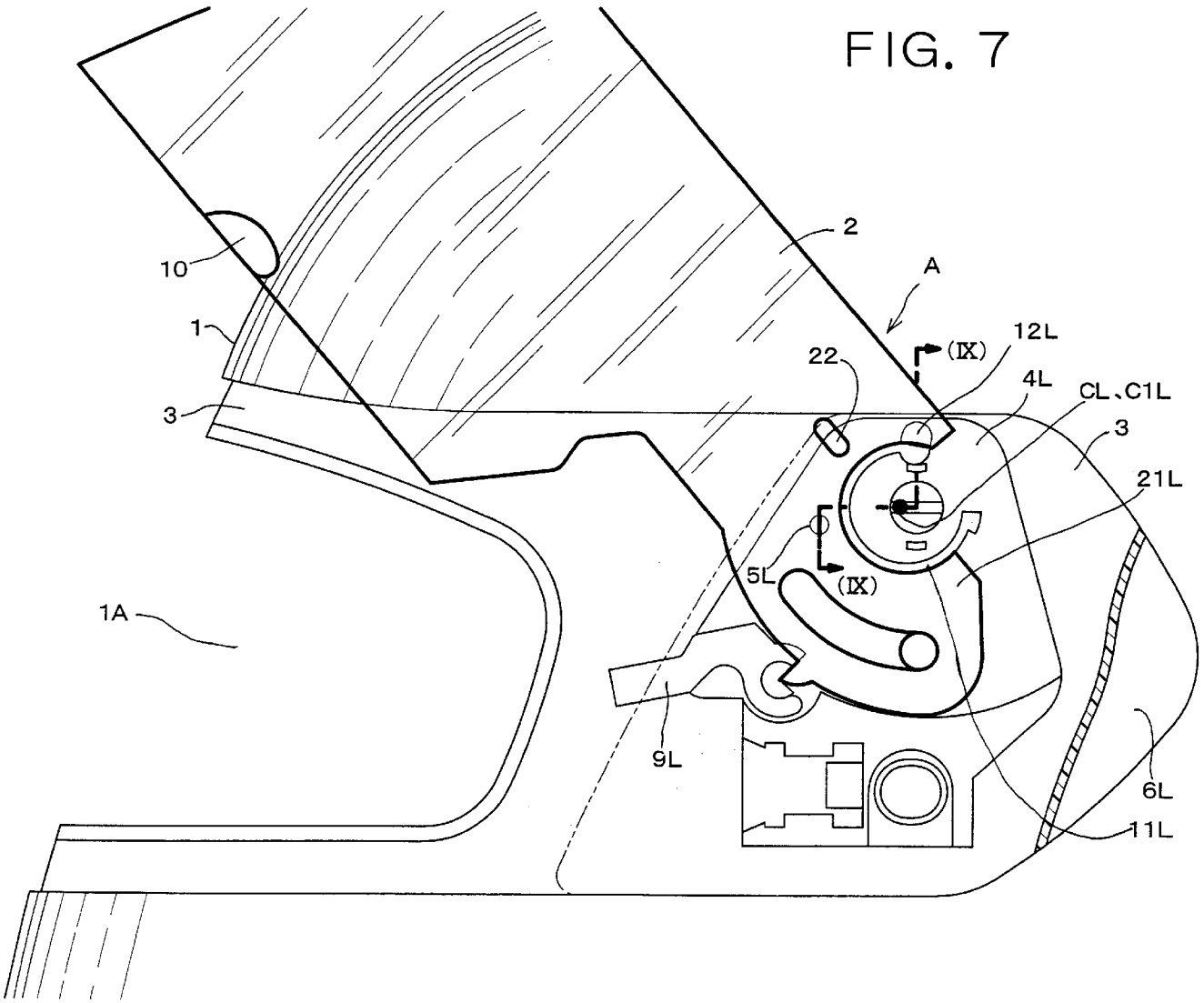
FIG. 7 is a left side elevational view for showing a state in which the shield is turned in an upward direction.
Figure 8:
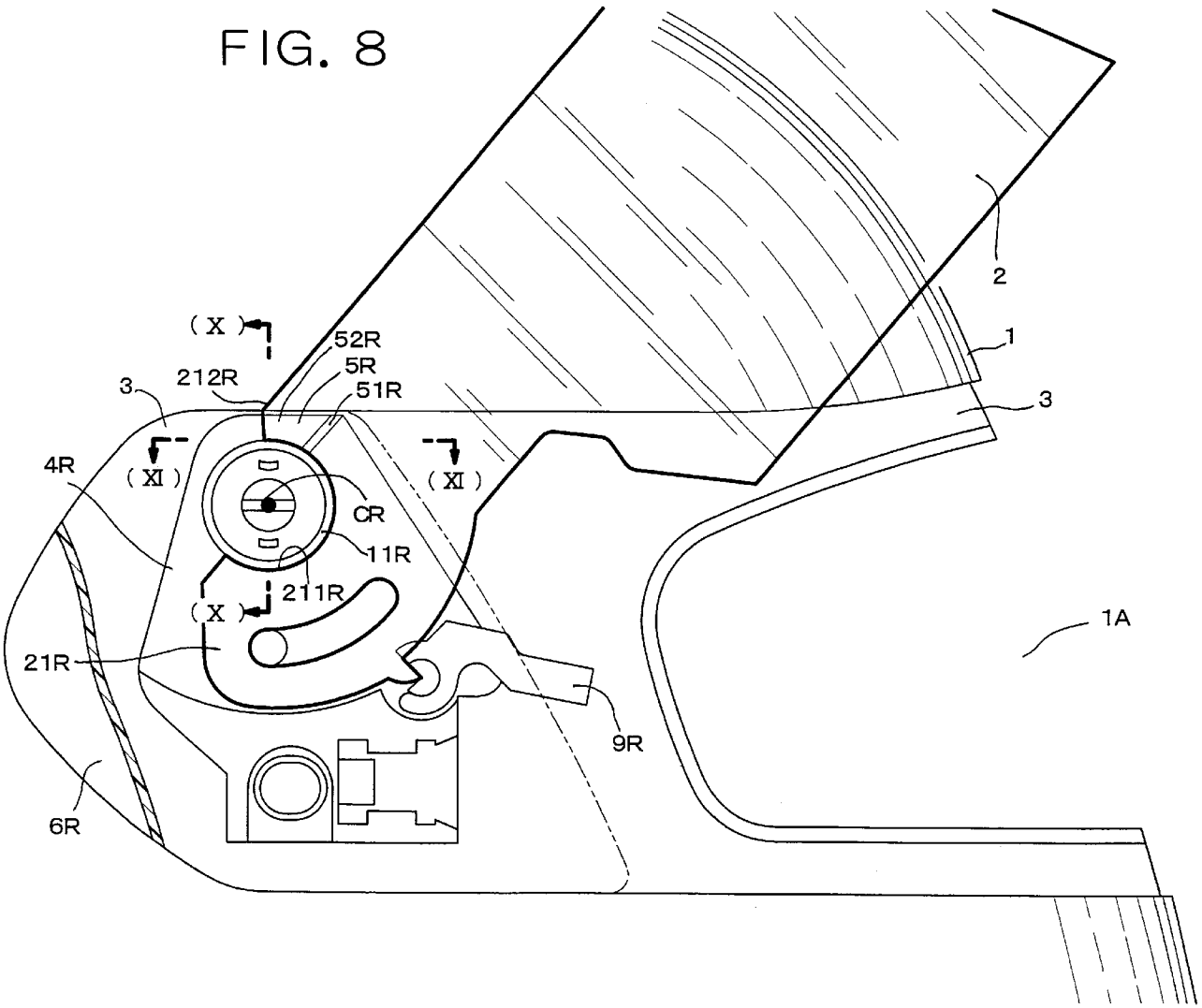
FIG. 8 is a right side elevational view for showing a state in which the shield is turned in an upward direction.
Figure 9:
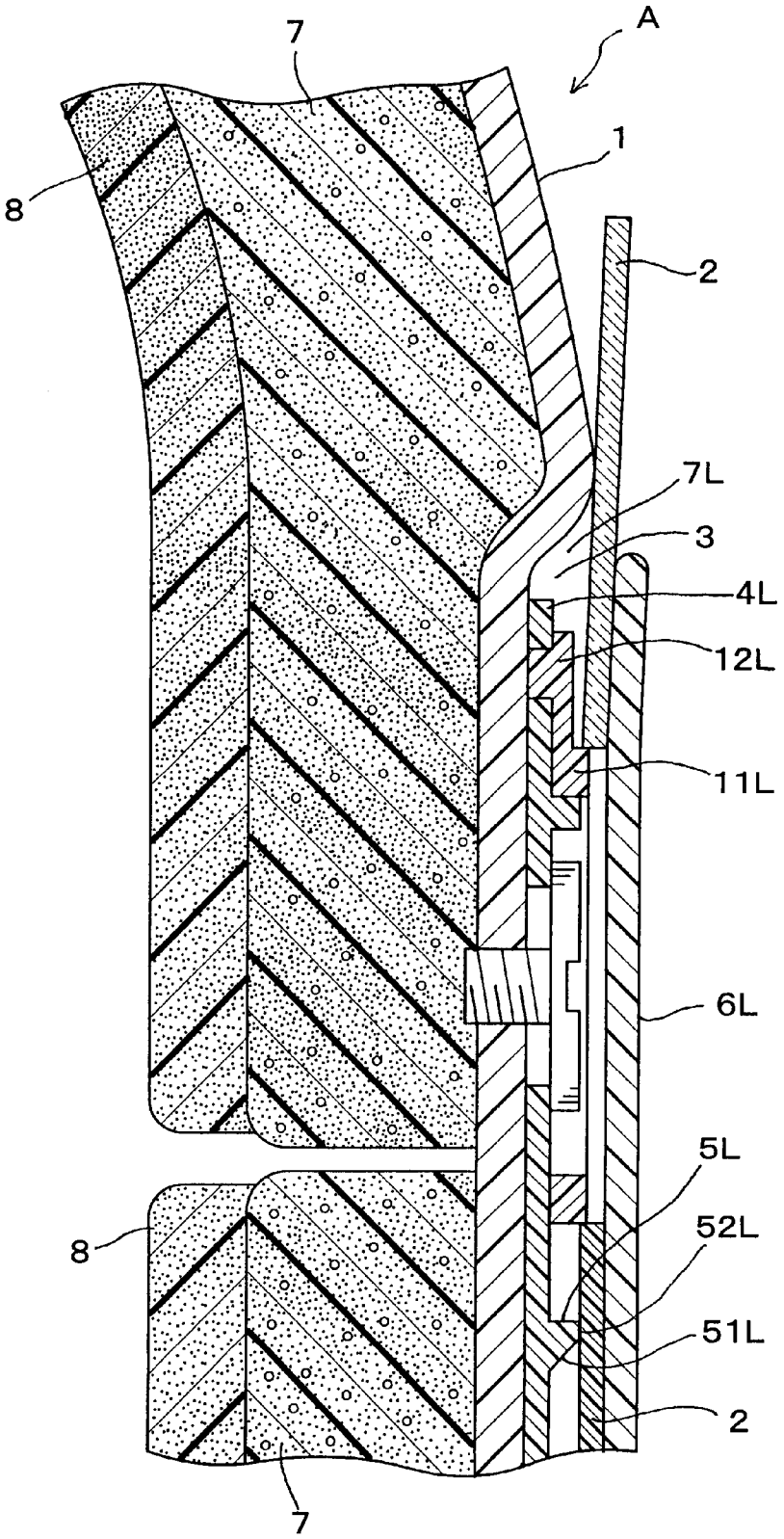
FIG. 9 is a sectional view taken along line (IX)—(IX) of FIG. 7.
Figure 10:
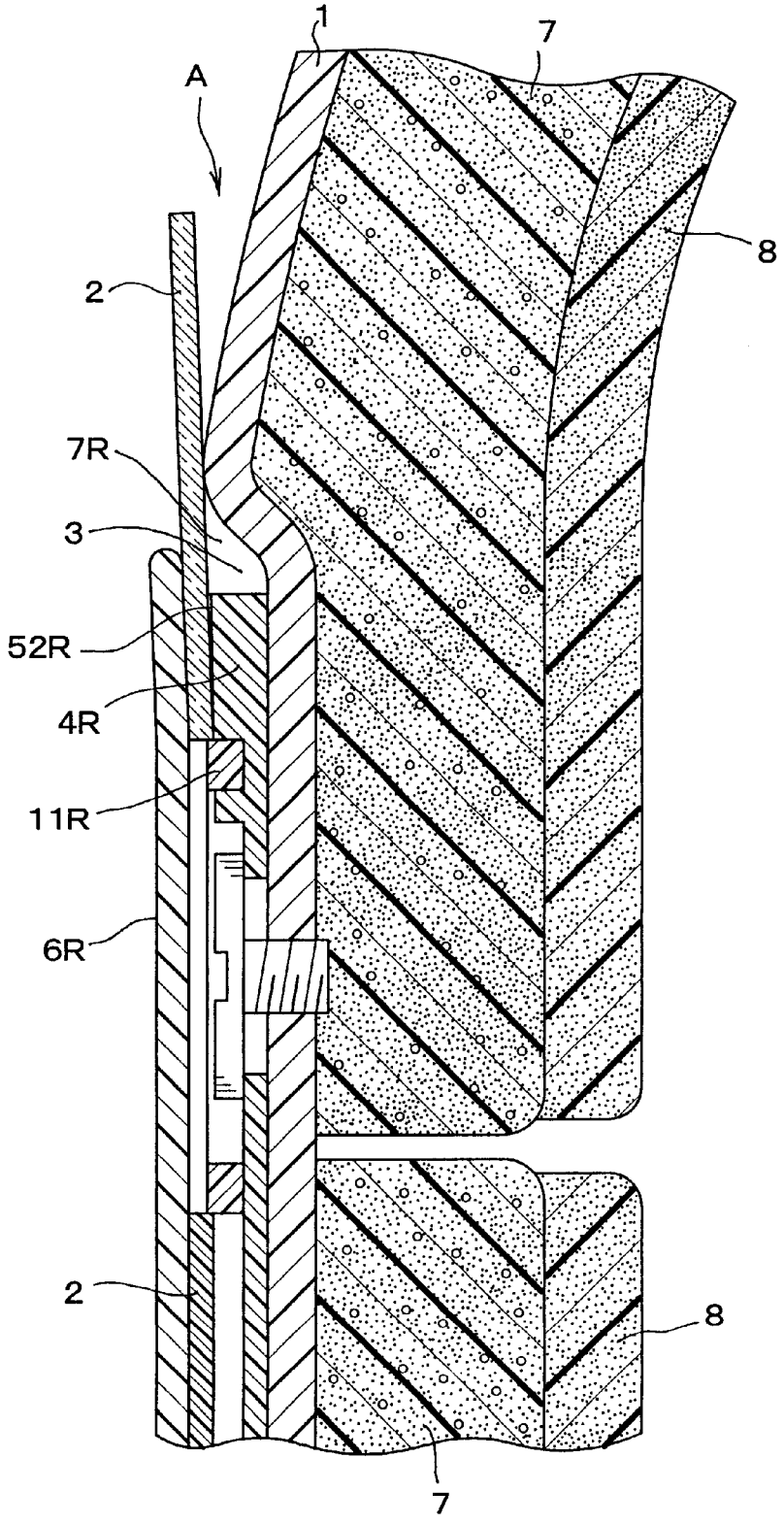
FIG. 10 is a sectional view taken along line (X)—(X) of FIG. 8.
Figure 12:
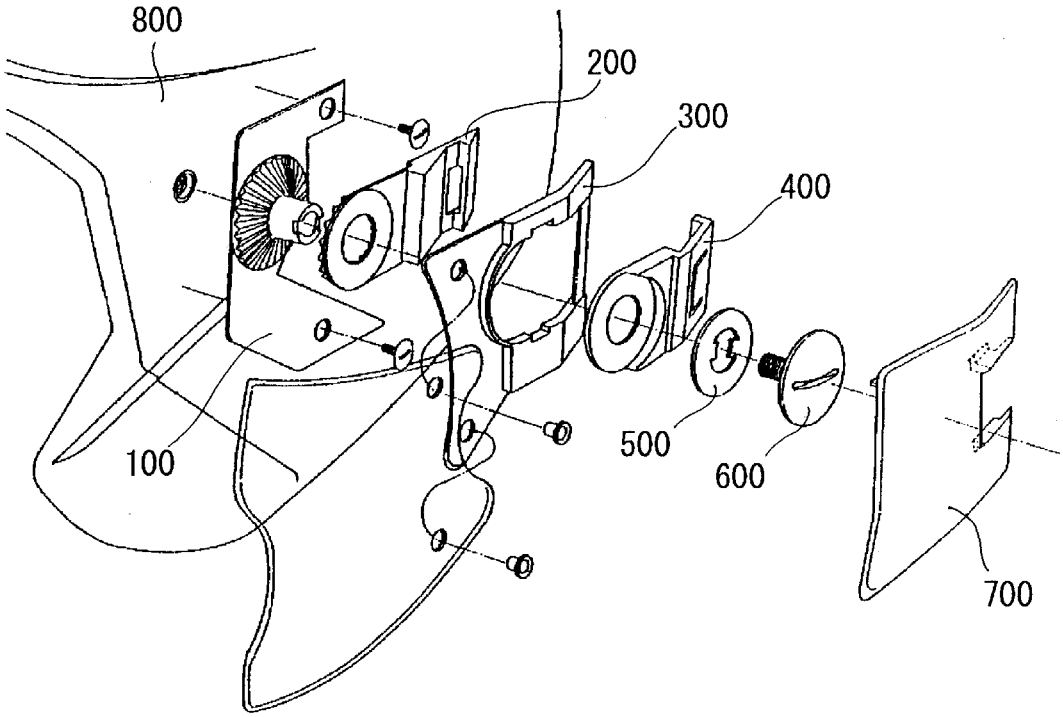
FIG. 12 shows a related art supporting structure.

The rotary centers CL, CR correspond to positions where the shield 2 is turned upward or downward and to positions where the front side of the shield 2 is disengaged from the step segment 3 when the center C1L of the supporting shaft 11L and the rotary center CL become concentric to each other, as shown in FIGS. 7 and 8.

Slant surface segments 5L, 5R are arranged on the base members 4L, 4R to protrude in outer rightward and leftward directions, and the slant surface segments are formed such that when the shield 2 is turned upwardly, their slant surfaces 51L, 51R cause the shield-fixing segments 21L, 21R to be expanded in outer rightward and leftward directions along the slant surfaces 51L, 51R.

In addition, the heights of the slant surface segments 5L, 5R are heights where the shield-fixing segments 21L, 21R can be disengaged from the step segment 3 when the shield-fixing segments 21L, 21R reach the apex points 52L, 52R of the slant surface segments 5L, 5R.

That is, as shown in FIGS. 1 to 4, the shield-supporting structure of the present invention is set such that when the shield 2 is fully closed, the shield 2 is accepted at the step segment 3 to cause the outer surface of the shell 1 to be substantially flush with the outer surface of the shield 2.

When the shield 2 is moved forward from this state as shown in FIG. 6, the supporting shaft 11L supporting the shield 2 moves forward, the center C1L of the supporting shaft 11L and the rotary center C1 become concentric to each other and at the same time the shield 2 is disengaged from the step segment 3 at the front side, resulting in upward turning of the shield 2 becoming possible.

When the shield 2 is turned upwardly from this state, the shield-fixing segments 21L, 21R ride over the slant surface segments 5L, 5R, and are disengaged from the step segment 3 while being expanded in outer rightward and leftward directions, resulting in the shield becoming fully opened as shown in FIGS. 6 to 9.

In order to change the shield from this full-opened state to the full-closed state, when the shield 2 is turned downwardly, the shield-fixing segments 21L, 21R kept opened in outer rightward and leftward directions are accepted in the step segment 3 while being closed inwardly along the slant surface segments 5L, 5R by their returning force from their own expanded and opened state.

Subsequently, when the shield is moved rearward from this state, the supporting shaft 11L moved rearward, the center C1L of the supporting shaft 11L is positioned at rear part of the rotary center CL, and the shield 2 is accepted at the step segment 3 at the front surface side, resulting in the shield becoming fully closed.

As described above, the shield supporting structure of the present invention is made such that one supporting shaft 11L for use in supporting the shield normally arranged at the helmet can be moved forward or rearward and at the same time the slant surface segments 5L, 5R are protruded and arranged at the front sides of the rotary centers CL, CR of both right and left sides of the shield 2 to cause the shield 2 to be protruded out of the step segment 3 or indented into the step segment 3, so that it is satisfactory that both sides of the shell 1 keep a notch having such a depth as one in which the outer surface of the shield 2 and the outer surface of the shell 1 become approximately in flush with each other.

Accordingly, the supporting structure of the present invention is satisfactory if a quite shallow notch of about the thickness of the shield is assured as compared with the notch corresponding to the thickness of the ratchet mechanism in the supporting structure described in the aforesaid gazette, so that the protrusion of the shield into the shell by this notch can be reduced, and a thickness required for safety characteristic at the shock absorbing liner can be assured without increasing the size of the shell.

In the foregoing description, although the left side supporting shaft 11L is moved forward or rearward, the present invention is not limited to this state, but its gist consists in the arrangement in which either one of the right and left supporting shafts is moved forward or rearward, so that it may also be applicable that the right side supporting shaft 11R is moved forward or rearward.

As means for further reducing wind-noise and preventing the shield from being dropped, the present invention provides a shield-supporting structure of a helmet wherein there are provided both right and left shield holders 6L, 6R for pushing both shield fixing segments 21L, 21R against the shell 1 from outside and holding them, and as pushing forces for the shield holders 6L, 6R, returning repelling forces of the shield holders 6L, 6R are utilized. (second aspect)

In accordance with the present invention, as shown in FIGS. 7 toll, upper passing spaces 7L, 7R by the upward turning of the shield 2 are formed between the outer surface of the shell 1 and the shield holders 6L, 6R while the shield holders 6L, 6R are being pushed wide in outer rightward and leftward directions under the outer rightward and leftward expansion of the shield fixing segments 21L, 21R by the upward turning of the shield 2.

When the shield 2 is turned downwardly from its full-opened state, the returning repelling force caused by the outer rightward and leftward pushing-out of the shield holders 6L, 6R may act against the shield fixing segments 21L, 21r and then the shield fixing segments 21L, 21R are pushed back to the step segment 3 by the returning repelling force.

As described above, the supporting structure of the present invention is constructed such that the passing spaces 7L, 7R are not present between the outer surface of the shell 1 and the shield holders 6L, 6R when the shield 2 is fully closed, and the passing spaces 7L, 7R are formed only after the upward turning of the shield 2, so that the thickness of each of the shield holders 6L, 6R can be reduced by the amount of the thickness corresponding to the passing spaces 7L, 7R.

That is, a protruding amount of the shield holders 6L, 6R in regard to the shell 1 can be reduced and the outer surface of the shell 1 and the outer surfaces of the shield holders 6L, 6R can be set substantially flush with each other or can be set substantially near flush with each other, so that it is possible to reduce the wind-noise generated by the shield holders 6L, 6R.

EXAMPLE

The preferred embodiment of the present invention will be described as follows, wherein the helmet of the preferred embodiment is a full-face type helmet.

The helmet A is made such that the shock absorbing liner 7 and the inner liner material 8 made of foam material are arranged inside the shell 1 made of fiber reinforced plastic material and the shield 2 closing the opening 1A is arranged from the front surface of the shell 1 over both right and left sides of it as shown in FIGS. 1 to 4.

The step segment 3 accepting the shield 2 when the shield is fully closed is formed over the circumferential edge of the opening 1A and both right and left sides of the shell 1, and when the shield 2 is fully closed, the shield is accepted in such a way that the outer surface of the shield 2 becomes substantially flush with the outer surface of the shell 1.

Reference symbols 4L, 4R denote base members fixed to both outer right and left surfaces of the helmet main body 1, and there are provided, on the base members 4L, 4R, supporting shafts 11L, 11R for rotatably supporting the shield fixing segments 21L, 21R of the shield 2, and the slant surface segments 5L, 5R for use in expanding the shield fixing segments 21L, 21R in outer rightward and leftward directions through upward turning of the shield 2.

In addition, shield holders 6L, 6R for pushing the shield fixing segments 21L, 21R against the shell 1 are engaged to the base members 4L, 4R.

The shield holders 6L, 6R cover the base members 4L, 4R by applying resilient synthetic resin material and their outer shapes are formed to be adapted for the step segment 3, wherein their outer surfaces are substantially flush with the outer surface of the shell 1 and they form a smooth continuous surface without any step there.

The supporting shaft 11L is formed with the fixing plates 12L at its upper location and the fixing plate 12L is pivotally supported at the base member 4L to enable itself to be turned in a forward or rearward direction and as this turning operation is carried out, the shield fixing segment 21L slides in the forward or rearward direction.

In addition, when the supporting shaft 11L is placed at the rearward position, its center C1L is located at a rear side of the rotary center CL and when it is turned in a forward direction, the center C1L becomes coaxial with the rotary center CL.

In turn, the supporting shaft 11R is fixed to the base member 4R.

In addition, both supporting shafts 11L, 11R have such an axial height as one in which the shield fixing segments 21L, 21R are not disengaged when the shield is fully opened in an expanded state.

The slant surface segment 5L is positioned in front of the rotary center CL, protruded outwardly and fitted to a long hole 22 opened in the shield fixing segment 21L and extending in a forward or rearward direction.

The lower portion of the slant surface segment 5L is formed with the slant surface 51L which is made such that the width of its extremity end may become narrow toward an axial outside part.

The long hole 22 is used for restricting the forward or rearward motion of the shield 2, wherein when the shield 2 is fully closed, the slant surface segment 5L is contacted with the front edge of the long hole 22, and when the shield 2 is moved forward, the slant surface segment 5L is contacted with the rear edge of the long hole 22 so as to restrict the forward or rearward motion of the shield 2.

Further, under a state in which the slant surface segment 5L is contacted with the rear edge of the long hole 22, the center C1L of the supporting shaft 11L becomes coaxial with the rotary center CL and the front side of the shield 2 is disengaged from the step segment 3 under this coaxial state (refer to FIG. 6).

That is, the upward turning of the shield 2 becomes possible at such time as described above.

Figure 2:
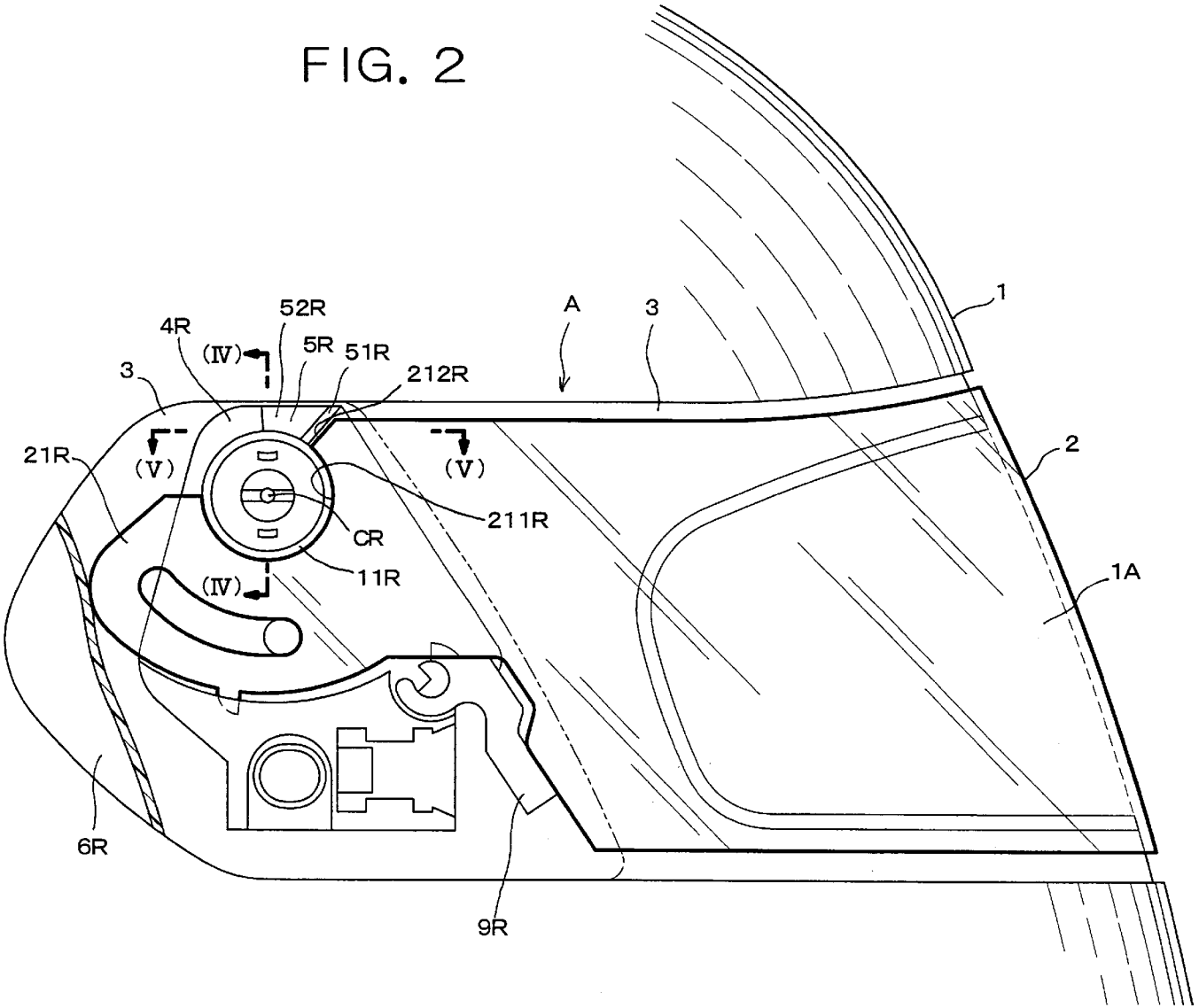
FIG. 2 is a right side elevational view of the helmet.
Figure 3:
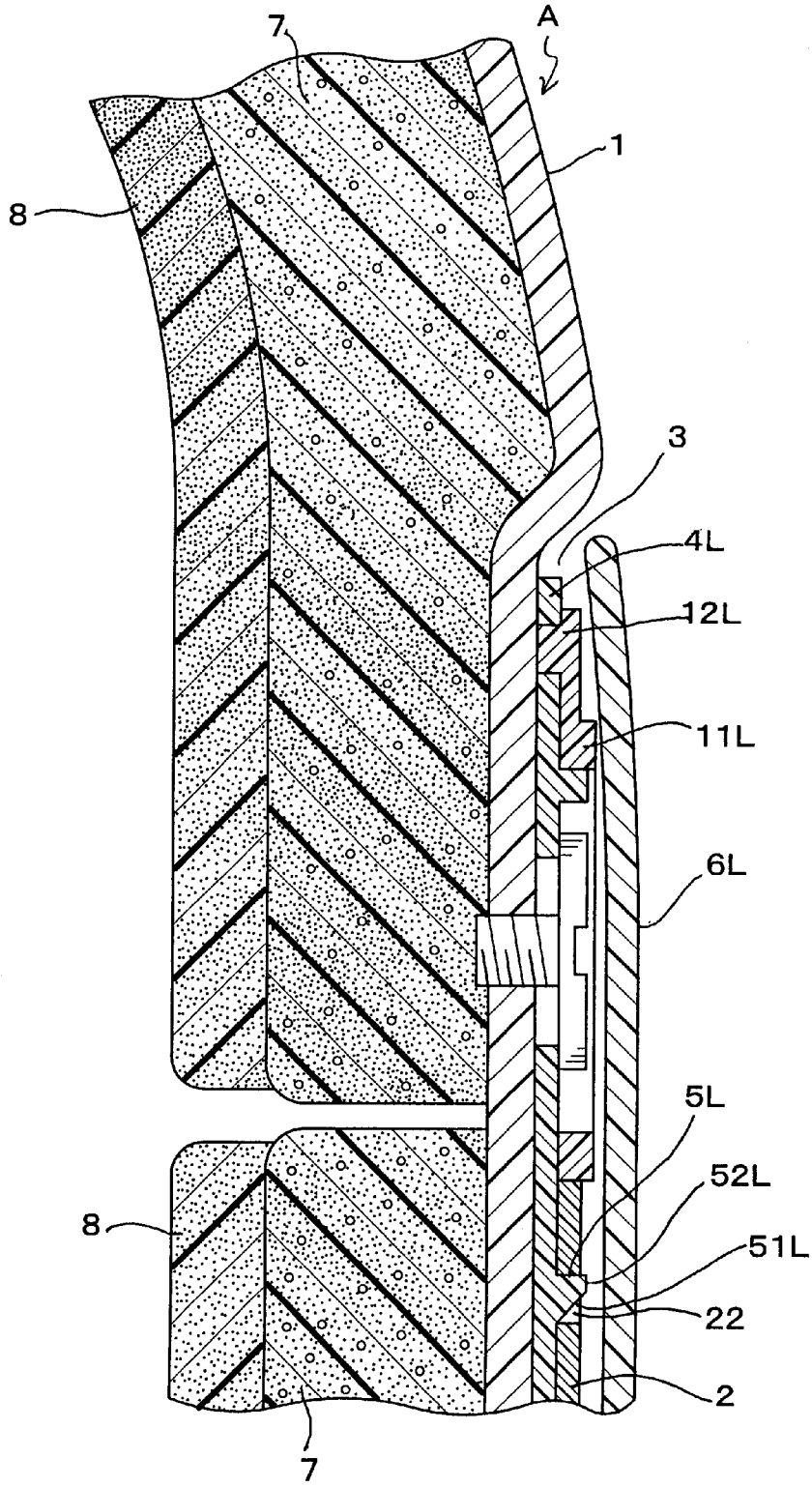
FIG. 3 is a sectional view taken along line (III)—(III) of FIG. 1.
Figure 4:
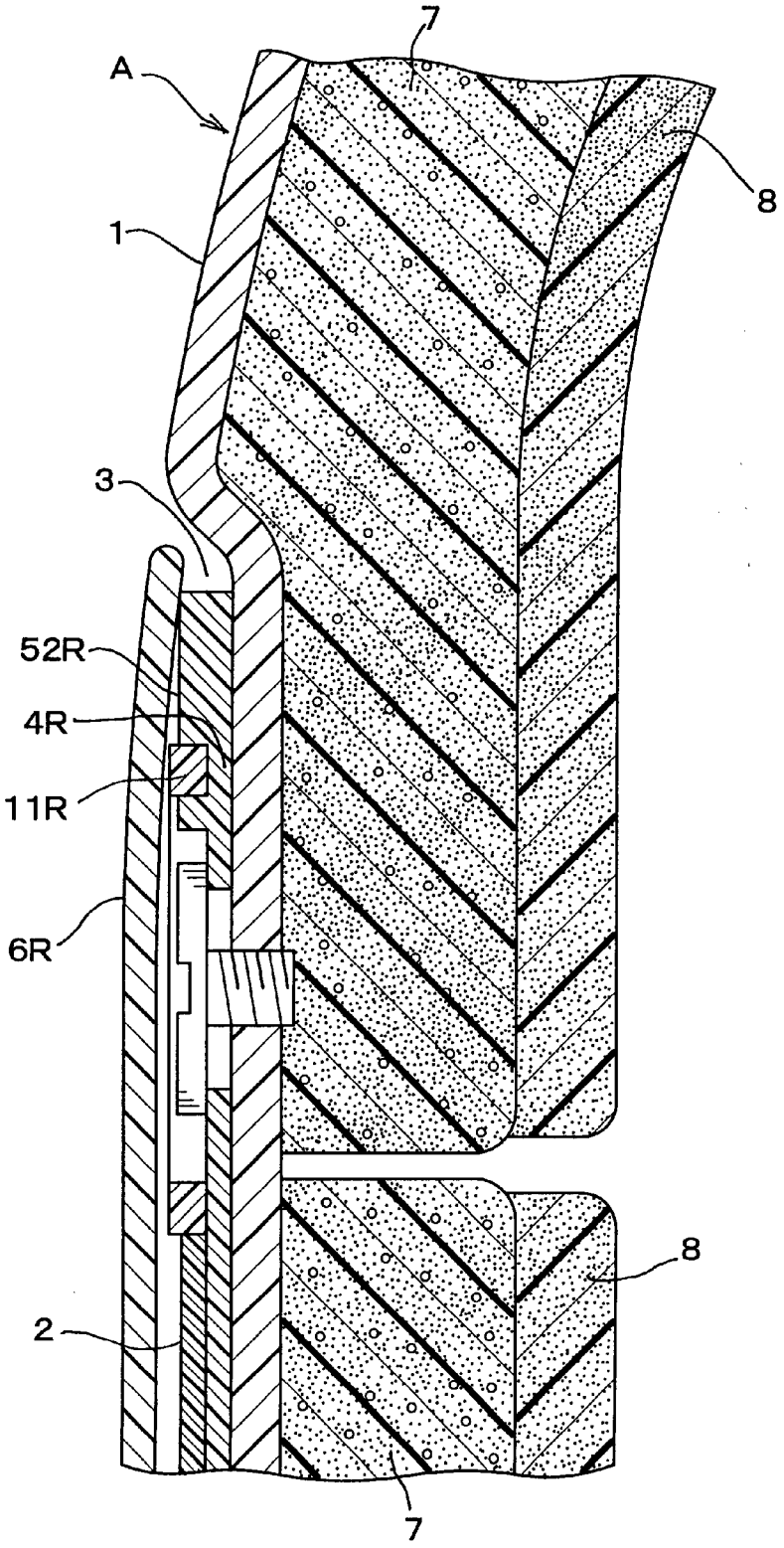
FIG. 4 is a side elevational view for showing a state in which the shield is turned in an upward direction.
Figure 5:
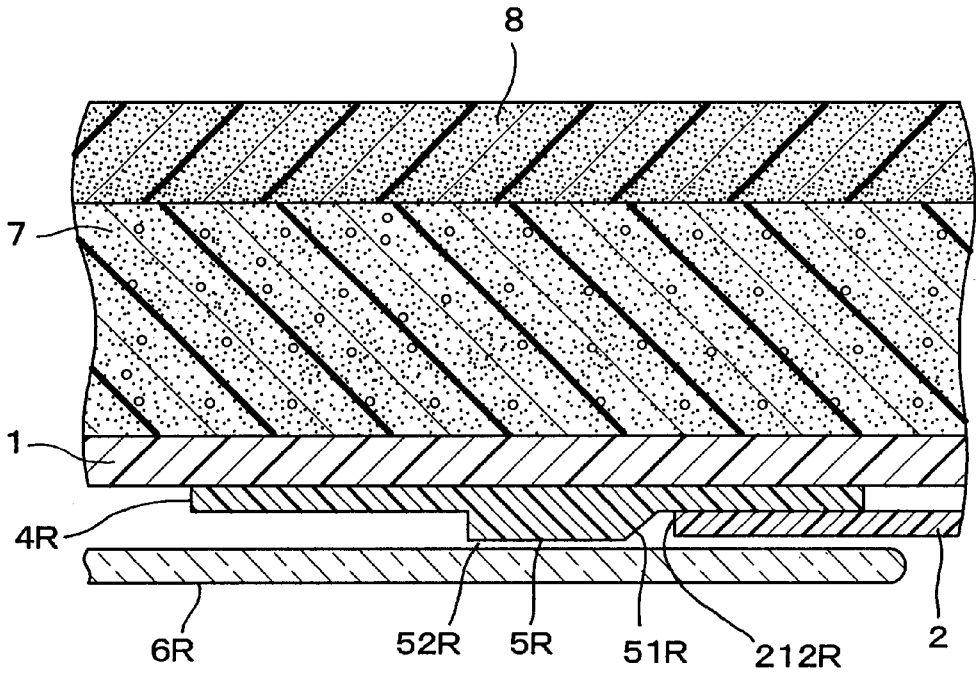
FIG. 5 is a sectional view taken along line (V)—(V) of FIG. 2.
Figure 11:
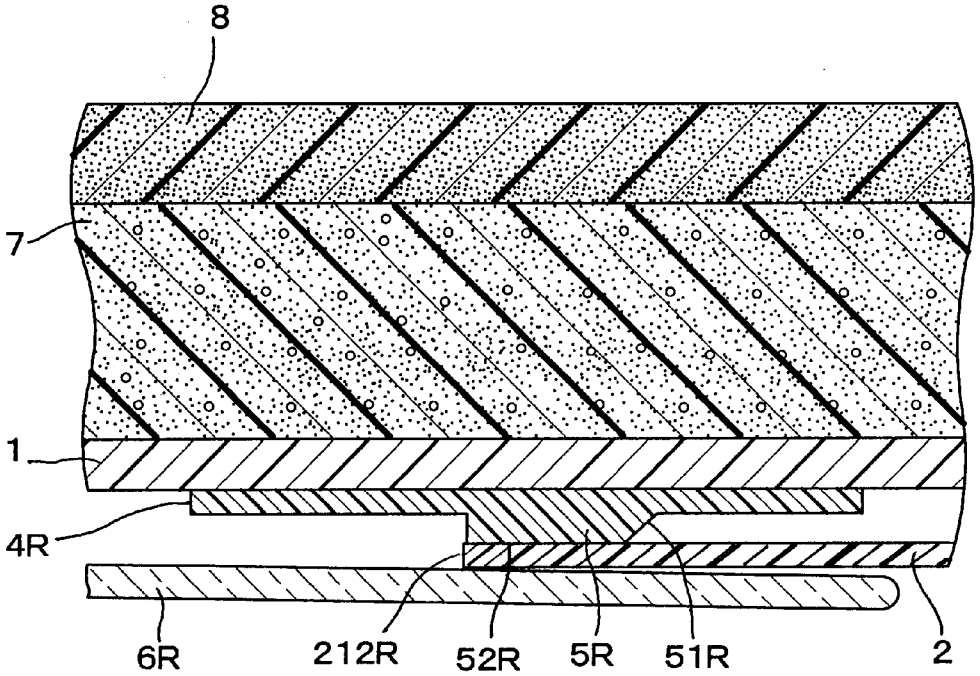
FIG. 11 is a sectional view taken along line (XI)—(XI) of FIG. 8.

As shown in FIGS. 2 and 5, the slant surface segment 5R is positioned above the supporting shaft 11R and the shield fixing segment 21R supported at the supporting shaft 11R is oppositely faced against the end part 212R at the front side of the recess 211R.

The slant surface segment 5R is formed with a slant surface 51R at a plane opposing against the end part 212R in a form in which its extremity end width is narrowed toward the axial outside of it.

When the shield 2 is turned upwardly from the aforesaid state in which the upward turning can be carried out, the lower edge of the long hole 22 is moved axially along the slant surface while the lower edge is being contacted with the slant surfaces 51L, thereby the shield fixing segment 21L is expanded in an outward direction, the long hole 22 is disengaged from the slant surface segment 5 and the shield fixing segment 21L is disengaged from the step segment 3 at the time when the shield fixing segment 21L rides over the apex point 52L of the slant surface segment 5L as shown in FIGS. 7 to 11.

In turn, at the right side surface, the end part 212R is moved axially along the slant surface while the end part is being contacted with the slant surface 51R, thereby the shield fixing segment 21R is expanded outwardly and the shield fixing segment 21R is disengaged from the step segment 3 at the time when the end part 212R rides over the apex point 52R of the slant surface segment 5R.

Then, this expansion produces a state in which the shield fixing segments 21L, 21R push to open the shield holders 6L, 6R in outer rightward and leftward directions and enter the passing spaces 7L, 7R while forming the upward turning passing spaces 7L, 7Rat the shield 2 between the inner sides of the shield holders 6L, 6R and apex points 52L, 52R of the slant surface segments 5L, 5R, and thereby the shield 2 is fully opened.

Under this full-opened state of the shield 2, the returning repelling force of the shield holders 6L, 6R may act on the shield fixing segments 21L, 21R to cause the shield fixing segments 21L, 21R to be pushed against the apex points 52L, 52R of the slant surface segments 5L, 5R.

In order to change the full-opened state of the shield 2 into its full-closed state, it is satisfactory to perform an inverse operation against the opening operation of the shield, and when the long hole 22 comes to the adapted position with the slant surface segment 5L at the left side surface during the lower turning operation of the shield 2, the long hole 22 is fitted to the slant surface segment 5L by the returning repelling force of the shield holder 6L, the lower edge of the long hole 22 moves toward the inner side while being guided by the slant surface 51L and finally the shield fixing segment 21L is accepted at the step segment 3.

On the other hand, at the right side surface, when the end segment 212R comes to the slant surface 51R from the apex point 52R of the slant surface segment 5R, the end segment 212R is moved inwardly while being guided by the slant surface 51R by the returning repelling force of the shield holder 6R and then the shield fixing segment 21R is accepted at the step segment 3.

Then, when the shield 2 is moved rearwardly from this state, the supporting shaft 11L is turned in a rearward direction and at the same time the center C1L of the supporting shaft 11L is disengaged from the rotary center CL, the front surface side of the shield 2 is also accepted at the step segment 3, resulting in that the outer surface of the shield 2 becomes substantially flush with the outer surface of the shell 1.

In the figure, reference numeral 10 denotes an operating segment where the shield is moved in a forward or a rearward direction and turned in an upward or a downward direction, and the operating segment 10 is held with fingers to cause the shield 2 to be moved in a forward or rearward direction and turned in an upward or downward direction.

Further, reference symbols 9L, 9R denote operating levers which are used in case of removing the shield 2 from the helmet, wherein the operating levers protrude when the shield 2 is fully opened and in turn when the protruded operating levers 9L, 9R are turned upwardly, the shield fixing segments 21L, 21R are further expanded to open and disengaged from the supporting shafts 11L, 11R to further push open the shield holders 6L, 6R and at the same time the passing spaces 7L, 7R are widened and the shield fixing segments 21L, 21R are pulled out of the widened passing spaces 7L, 7R.

As to the supporting structure provided with the operation levers, this has already been filed by the present applicant and registered, so that the description about a practical construction and operation will be omitted (Registered U.S. Pat. No. 3,045,718).

In addition, although the preferred embodiment of the present invention has been described in reference to the example of the full-face type helmet, the fixing structure can also be worked in the open face type helmet.

EFFECTS OF THE INVENTION

As described above, since the shield supporting structure of the present invention is a structure in which the notches at the right and left side surfaces of the shell can be made quite shallow as compared with that of the structure described in the gazette, it is possible to reduce the protrusion of the shield into the shell caused by the notches.

Accordingly, the outer surface of the shield can be substantially in flush with the outer surface of the shell without reducing the thickness of the shock absorbing liner or increasing the dimension of the shell, so that it is possible to reduce wind-noise and entering of rain water.

Further, as compared with the ratchet mechanism described in the gazette, the number of component parts is less and their constitution is also quite simple, so that the present invention may contribute substantially to reduction in cost and its maintenance is also simple.

Further, this invention is a structure in which the front side of the shield is disengaged from the step segment by the forward or rearward motion of either one of the right and left supporting shafts to enable the shield to be turned in an upward or downward direction, so that the shield can be opened or closed with one hand.

In addition, in accordance with the second aspect of the present invention, an amount of protrusion of the shield holders against the shell is reduced, resulting in that the outer surface of the shell can be substantially in flush with the outer surfaces of the shield holders or can be substantially near in flush with each other.

Accordingly, in addition to the aforesaid effects, the wind-noise generated by the shield holder can be further reduced.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A helmet which comprises:

a shell that includes a front and opposite first and second sides and which defines a step area for a shield, said first side including a first base member and said second side including a second base member, said first base member having a first outwardly-extending support shaft that is movable between a rearward position and a forward position, and a first outwardly-extending slant member located forwardly of said first support shaft, said first slant member having a sloped bottom side and a free end opposite said shell, said second base member having a second outwardly-extending support shaft and a second outwardly-extending slant member having a sloped side and a free end opposite said shell, and a shield which is movable between a first position where said shield is positioned within said step area and flush with an outer contour of said shell, and a second position where a front portion of said shield is located forwardly of said front of said shell and can be upwardly rotated about said first and second supporting shafts, said shield including first and second side segments which are respectively rotatable around said first and second supporting shafts, said first side segment including an elongated slot in which said first slant member extends, said shield being movable from said first position to said second position when said first side segment of said shield is manually moved forward due movement of said first supporting shaft from said rearward position to said forward position, said shield being thereafter manually upwardly rotatable due to movement of said first and second side segments of said shield up said sloped sides of said respective first and second slant segments and over said free ends thereof.

2. A helmet according to claim 1, including first and second shield holders for respectively biasing said first and second side segments toward said helmet shell.

* * * * *